United States Patent [19]

Sato

[11] Patent Number: 4,769,640

[45] Date of Patent: Sep. 6, 1988

[54] IMAGE PROCESSING SYSTEM

[75] Inventor: Hitoshi Sato, Utsunomiya, Japan

[73] Assignee: Kabushiki Kaisha Toshiba, Kawasaki, Japan

[21] Appl. No.: 651,705

[22] Filed: Sep. 18, 1984

[30] Foreign Application Priority Data

Sep. 20, 1983 [JP] Japan ..... 58-174795

[51] Int. Cl.[4] ..... G09G 1/16

[52] U.S. Cl. ..... 340/799; 340/731; 340/814

[58] Field of Search ..... 340/727, 729, 731, 728, 340/747, 814

[56] References Cited

U.S. PATENT DOCUMENTS

| | | | |
|---|---|---|---|
| Re. 31,200 | 4/1983 | Sukonick | 340/799 |
| 3,678,497 | 7/1972 | Watson et al. | 340/735 |
| 4,069,511 | 1/1978 | Lelke . | |
| 4,205,389 | 5/1980 | Heartz . | |
| 4,243,984 | 1/1981 | Ackley et al. | 340/725 |
| 4,267,573 | 5/1981 | Chaikin et al. | 340/727 |
| 4,356,482 | 10/1982 | Oguchi . | |
| 4,364,090 | 12/1982 | Wendland . | |
| 4,414,628 | 11/1983 | Ahuja et al. . | |
| 4,489,389 | 12/1984 | Beckwith et al. | 340/729 |
| 4,496,944 | 1/1985 | Collmeyer et al. . | |
| 4,550,315 | 10/1985 | Bass et al. . | |
| 4,573,080 | 2/1986 | Maze . | |

*Primary Examiner*—Marshall M. Curtis

*Attorney, Agent, or Firm*—Finnegan, Henderson, Farabow, Garrett and Dunner

[57] ABSTRACT

An image display apparatus uses a frame memory as an image data storage section for storing original data prior to image processing and a display memory for storing display image data. Image data transfer from the frame memory to the display memory is performed by a memory controller in accordance with a DMA (direct memory access) scheme. The image data transfer is performed through a data conversion memory which is programable under the control of a CPU, thereby performing data conversion as image processing. The data transfer by the memory controller is performed such that at least a desired part of the image data from the frame memory is transferred to the display memory through the data conversion memory in response to an address signal synchronized with a sync signal used for reading out the image data from the display memory and displaying the image data on a display unit.

8 Claims, 7 Drawing Sheets

IMAGE PROCESSING SYSTEM

BACKGROUND OF THE INVENTION

The present invention relates to an image processing system used in tomographic equipment such as X-ray computed tomographic equipment and a magnetic resonance imaging system or MRI system.

An image display apparatus is arranged in conventional X-ray computed tomographic equipment or a conventional magnetic resonance imaging system to display output image information. In such an image display apparatus, cine display (motion display) for displaying motion of a stomach or a heart is performed in addition to still image display. The cine display of an image in, for example, a $512^2$ ($512\times512$) matrix corresponds to a sequential display of 20 to 30 still images per second. For the cine display in a conventional image display system, if a series of images (since the images are sequentially displayed while each image is displayed for a predetermined period of time) to be recognized as substantially a one-frame still image is given to an image unit, image information corresponding to 20 to 30 still images of the $512^2$ matrix is stored in a memory, and the 20 to 30 still images, data of which are stored in the memory, are switched at high speed and displayed. Therefore, in order to perform cine display, a very large capacity memory must be used. In addition, since the images stored in the memory are sequentially read out, switched and displayed, it is very difficult to perform the cine display in the conventional image display apparatus.

Furthermore, when window processing is performed for the image information (gradation is provided in a specific range of the original gradation data), a larger capacity memory than that described above is required, and the memory switching access becomes more complicated. Image information write/read access with respect to the memory and window processing are performed by a common central processing unit (CPU). Therefore, display image switching is greatly degraded.

SUMMARY OF THE INVENTION

It is an object of the present invention to provide a simple image processing system, wherein a plurality of images can be easily switched and displayed on a display means.

According to the image processing system of the present invention, a frame memory for storing original data prior to image data processing and a display memory for storing display image data are used, and image data transfer from the frame memory to the display memory is performed by a memory control unit in accordance with a DMA (direct memory access) scheme. In addition, this data transfer is also performed through a data conversion memory which is programmable under the control of the CPU, thus performing data conversion as image processing (e.g., window processing). When data is transferred by the memory control unit, at least a desired part of the image data from the frame memory is transferred to the display memory through the data conversion memory in accordance with an address signal, synchronized with a sync signal, used for reading out the image data from the display memory and displaying the image data on the display apparatus. Therefore, according to this image processing system, the DMA transfer of the image data from the frame memory to the display memory is performed such that part of the data from the frame memory is transferred in synchronism with read scanning of the image data from the display memory.

According to the image display apparatus of the present invention, a desired portion of the plurality of images stored in the frame memory is image-processed and partially transferred in synchronism with the sync signal of the display apparatus in such a manner that a start address of the frame memory corresponds to the frame sync signal (normally, a vertical sync signal) of the display apparatus. Therefore, even if the display apparatus has a simple construction, the switching operation of the plurality of images is performed at high speed at the display apparatus. Therefore, cine display can be performed.

DETAILED DESCRIPTION OF THE PREFERRED EMBODIMENTS

Figure 1:
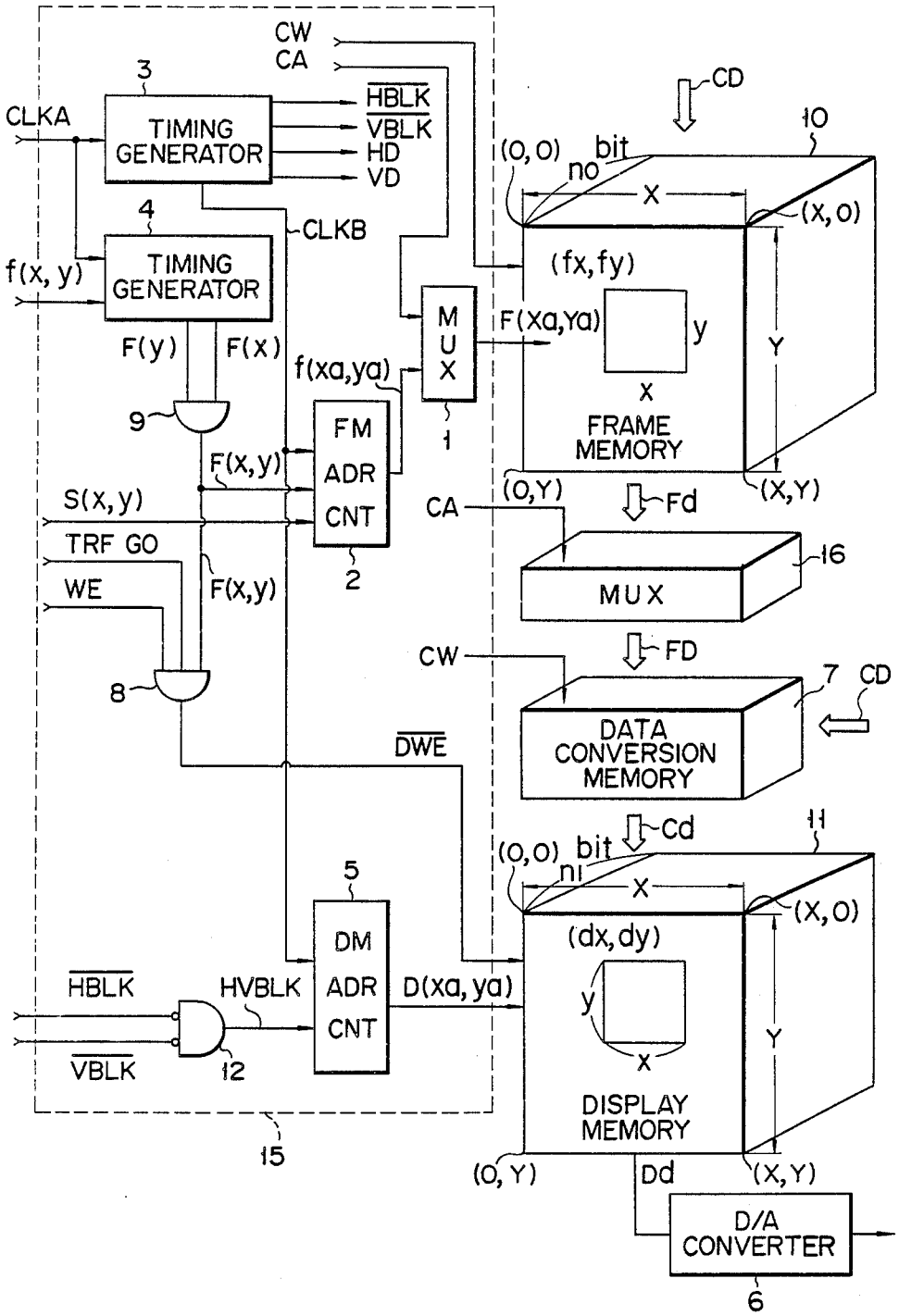
FIG. 1 is a block diagram showing a schematic configuration of an image display apparatus according to a first embodiment of the present invention.

Referring to FIG. 1, a frame memory 10 stores image data CD transferred from an external memory in response to a write signal CW supplied from a CPU (central processing unit) (not shown) under the control of the CPU. Output data Fd read out from the frame memory 10 is supplied to a data conversion memory 7 through a multiplexer (MUX) 16. The data conversion memory 7 has a capacity of $2\times n1$ bits. The data conversion memory 7 converts the n0-bit data Fd read out from the frame memory 10 to n1-bit data Cd. The data conversion memory 7 can be accessed by the CPU. Various types of tables are selectively written in the data conversion memory 7 under the control of the CPU. These various types of tables are used to convert the data Fd into the n1-bit data Cd. The output Cd from the data conversion memory 7 is located at the same x and y addresses as those of data stored in the frame memory 10. The data Cd is supplied to a display memory 11 connected to the output of the data conversion memory 7. An output Dd from the display memory 11 is supplied to a display unit (not shown) such as a CRT display through a D/A (digital-to-analog) converter 6.

The arrangement of a memory controller 15 for controlling the operation of the frame memory 10 and the display memory 11 will now be described.

A timing generator 3 in the memory controller 15 generates, in response to an externally supplied reference clock CLKA, a horizontal sync signal HD, a vertical sync signal VD, a horizontal blanking signal $\overline{HBLK}$, a vertical blanking signal $\overline{VBLK}$ and a signal CLKB, which are used for image display at the display unit (not shown). The signal CLKB is supplied to a frame memory address counter (FM ADR CNT) 2 and a DM (display memory) address counter (DM ADR CNT) 5, which are connected to the output of the timing generator 3. A timing generator 4 also receives the reference clock CLKA and a signal f(x,y) for setting the predetermined size (partial transfer size to be described in detail later) of the frame memory 10 through the CPU upon being operated by the operator. The timing generator 4 generates signals F(x) and F(y) which are respectively synchronized with the horizontal sync signal HD and the vertical sync signal VD. The signals F(x) and F(y) from the timing generator 4 are supplied as a partial transfer address signal F(x,y) to the FM address counter 2 through a 2-input AND gate 9. The partial transfer address signal F(x,y) is also supplied to a 3-input AND gate 8.

The FM address counter 2 comprises a programmable sync counter (e.g., an SN74163 available from Texas Instruments Inc.). The FM address counter 2 receives the signal CLKB from the timing generator 3, the partial transfer address signal F(x,y) from the AND gate 9, and an externally supplied frame memory start address signal S(x,y), and generates a signal f(xa,ya). The signal f(xa,ya) is supplied to one input terminal of a multiplexer (MUX) 1 connected to the FM address counter 2. The multiplexer 1 selects one of the output signals f(xa,ya) from the FM address counter 2 and an address signal CA, transferred from the CPU address bus, and generates the selected signal as an address signal F(xa,ya) to the frame memory 10.

The AND gate 8 receives the partial transfer address signal F(x,y) from the AND gate 9, and a partial transfer start signal TRFGO and a write signal WE, which are externally supplied. The AND gate 8 generates a write signal $\overline{DWE}$, which is supplied to the display memory 11.

An AND gate 12 having two inverting input terminals receives the horizontal blanking signal $\overline{HBLK}$ and the vertical blanking signal $\overline{VBLK}$, which are supplied from the timing generator 3. The AND gate 12 supplies a count enable signal HVBLK to the DM address counter 5. The DM address counter 5 also receives the signal CLKB from the timing generator 3 and generates an address signal D(xa,ya) to be supplied to the display memory 11.

The memory controller 15 having the arrangement described above is operated as follows.

First, image data write control for the frame memory 10 will be described.

When image data is written in the frame memory 10, the multiplexer 1 is enabled in response to the address signal CA transferred from the CPU address bus. The address signal CA is transferred from the multiplexer 1 to the frame memory 10. The frame memory 10 stores image data transferred from the CPU in response to the address signal CA and the write signal CW.

The signal f(x,y) supplied to the timing generator 4 comprises address data which represents the position and size of the preset partial transfer area, obtained by preediting such that an operator moves a joy stick to shift a marker on the display screen so as to specify x and y coordinates. The signal f(x,y) is supplied to the timing generator 4 through the CPU or the like.

The address signal F(xa,ya) for the frame memory will be described.

The address signal F(xa,ya) is an output from the multiplexer 1 when the multiplexer 1 selects the output f(xa,ya) from the FM address counter 2. The AND signal F(x,y) of the outputs F(x) and F(y) from the timing generator 4 is used as a load instruction signal. The externally supplied start address signal S(x,y) is used as a load input (the preset value). The FM address counter 2 is preset at the load input value in response to the load instruction signal. Under these assumptions, the contents of the frame memory 10 are read out in response to the output f(xa,ya) from the FM address counter 2. The n0-bit image data Fd read out of the frame memory 10, is selected by the multiplexer 16 and is converted by the data conversion memory 7 to n1-bit image data Cd. As previously described, the data conversion memory 7 stores various types of conversion tables supplied from the CPU. These conversion tables are written in the data conversion memory 7 in response to the data CD and the write signal CW, which are supplied from the CPU when the data conversion memory 7 is enabled in response to the address input as the CPU address CA supplied from the CPU through the multiplexer 16.

Data is written in the display memory 11 when the output $\overline{DWE}$ from the AND gate 8 is enabled. The write/read address of the display memory 11 is accessed by the output D(xa,ya) from the DM address counter 5, which receives the output CLKB from the timing generator 3 and the AND output HVBLK (output from the AND gate 12) of the horizontal and vertical blanking signals $\overline{HBLK}$ and $\overline{VBLK}$. The output D(xa,ya) starts at (0,0) and is sequentially changed in an order of (1,0), (2,0), . . . (X,0), (0,1), (1,1), (2,1), (3,1), . . . (0,Y), (1,Y), (2,Y), . . . (X,Y), (0,0), (1,0) . . . The output D(xa,ya) is synchronized with the horizontal and vertical signals HD and VD of the display apparatus. The signal Dd read out from the display memory 11 in response to the signal D(xa,ya) is supplied as a video signal to the display unit through the D/A converter 6. The image data is thus displayed on the display unit.

In this manner, the frame memory 10 and the display memory 11 are controlled by the memory controller 15, so that only the specified portion of image data is transferred (partial transfer) from the frame memory 10 to the display memory 11.

The partial transfer according to the image display apparatus of the first embodiment will be described.

Figure 3:
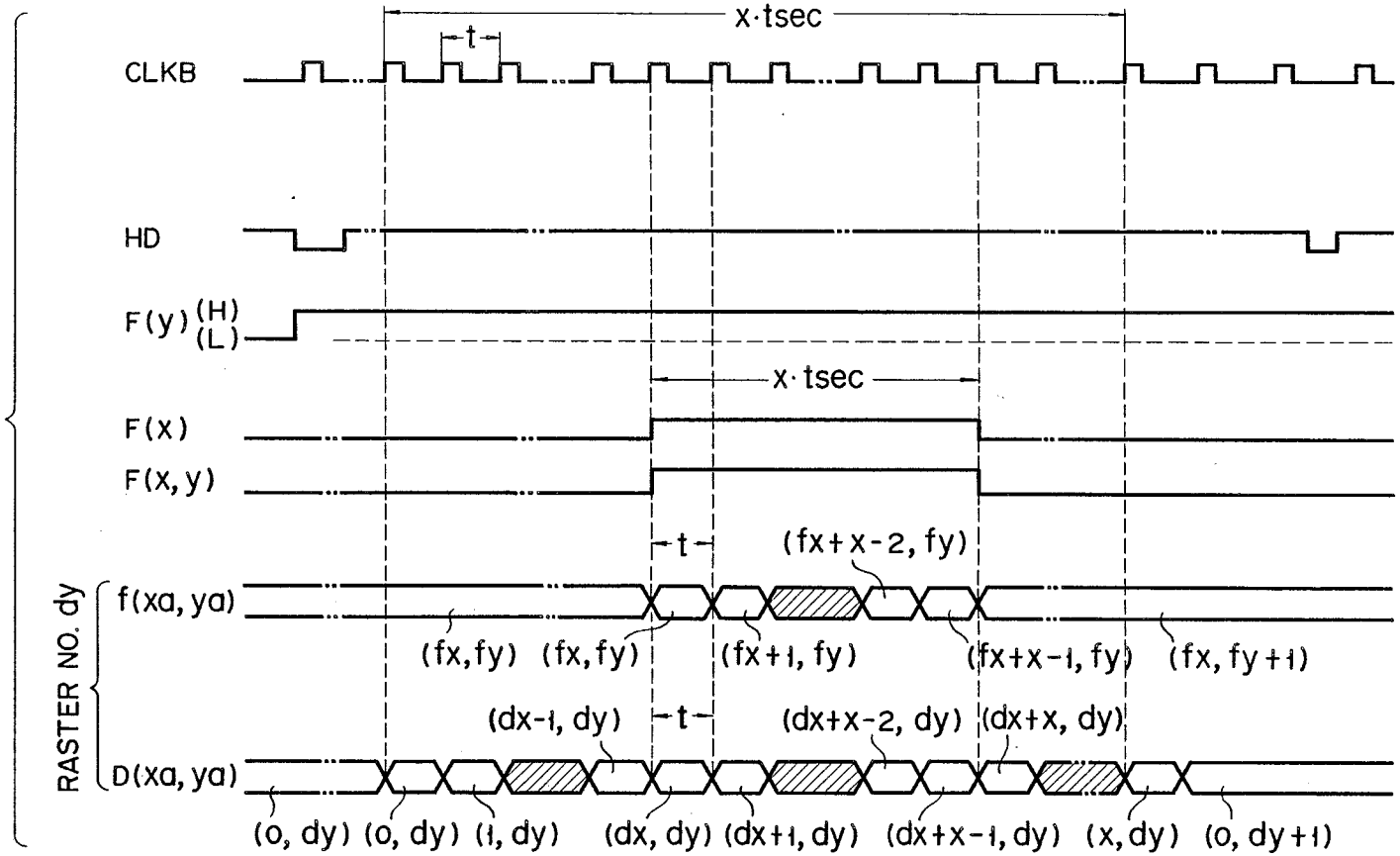

When only image data indicated by the hatched portion in the frame memory 10 is transferred, a start address (fx, fy) is supplied as the signal S(x,y) to the FM address counter 2. The partial matrix size x,y is supplied as the signal F(x,y) to the timing generator 4. The timing generator 4 receives the signal f(x,y) and generates the partial transfer address signals F(x), F(y) which are respectively synchronized with the horizontal and vertical sync signals HD and VD, as shown in FIG. 3. When the clock pulse CLKB is received by the DM address counter 5, an address D(xa,ya) of the display memory 11 is incremented. When the count reaches an address (dx,dy), the FM address counter 2 is enabled in response to the signal F(x,y). The FM address counter 2, as the programable sync counter, is simultaneously preset and enabled when it receives as the signals fx and fy the start address S(x,y) from the frame memory 10. The signal F(xa,ya) is synchronized with the up-counting of the address of the display memory 11. Therefore, the FM address counter 2 is set in the address increment mode. When the AND gate 9 is enabled (in this case, the externally supplied signal TRFGO for the partial transfer mode goes to "H" (high level), the signal $\overline{DWE}$ is enabled. In this state, the display memory 11 is set in the write mode.

The operation timings for the partial transfer will be described with reference to FIGS. 2 to 5.

Figure 2:
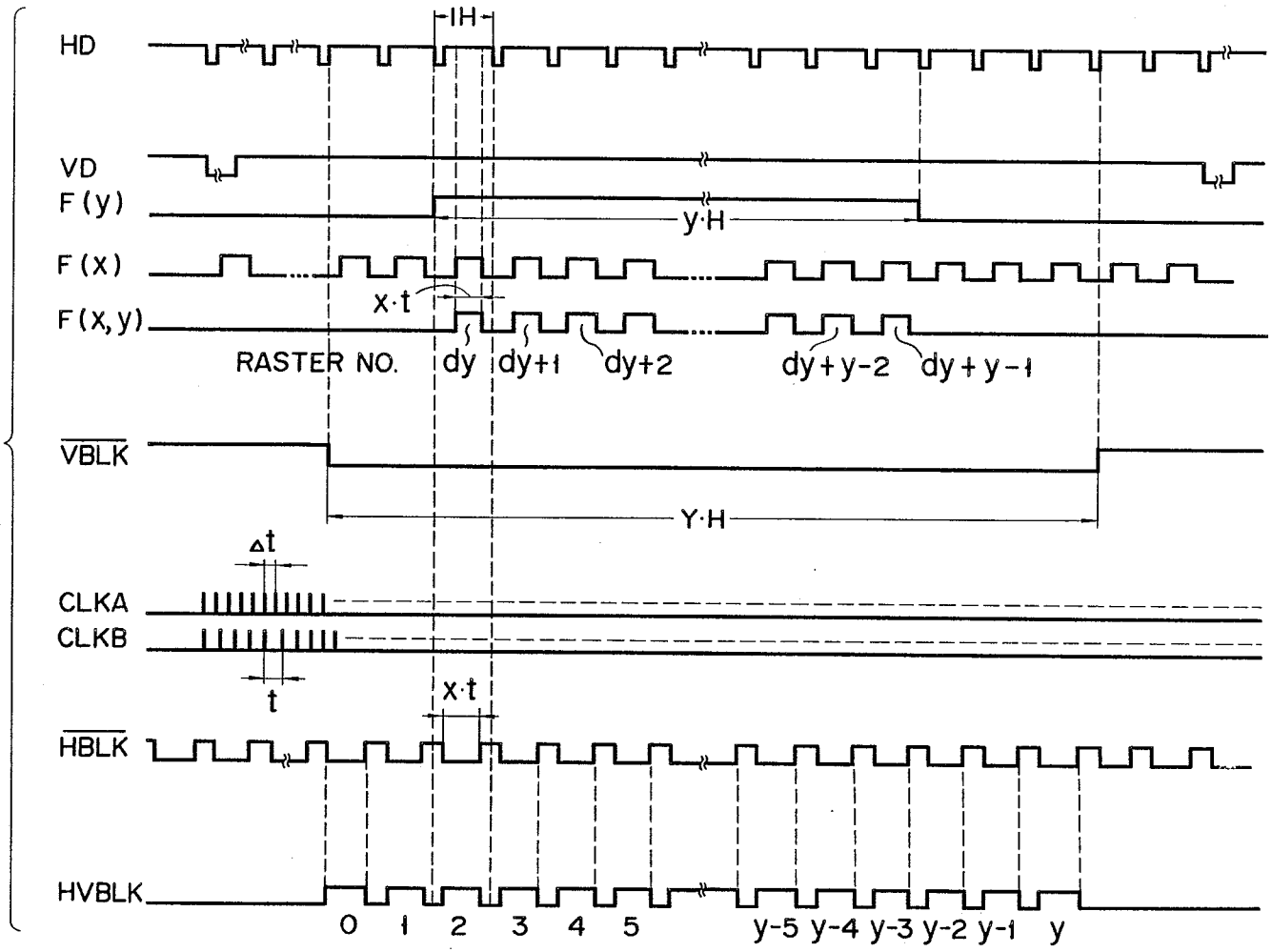
FIGS. 2 to 5 are respectively timing charts of signals for explaining the operation of the apparatus shown in FIG. 1.

Referring to FIG. 2, the signals F(x) and F(y) respectively comprise partial transfer X address F(x) and partial transfer Y address F(y), generated from the timing generator 4 in synchronism with the horizontal and vertical syne signals HD and VD in accordance with the frame start address f(x,y) selected for the desired partial transfer. The signal F(x,y), which is the AND output of the signals F(x) and F(y), is generated from the AND gate 9. The y·H period of the signal F(y) becomes a partial transfer time (corresponding to the partial transfer address). The NAND output HVBLK of the signals $\overline{VBLK}$ and $\overline{HBLK}$ from the timing generator 3 is generated from the AND gate 12.

Figure 4:
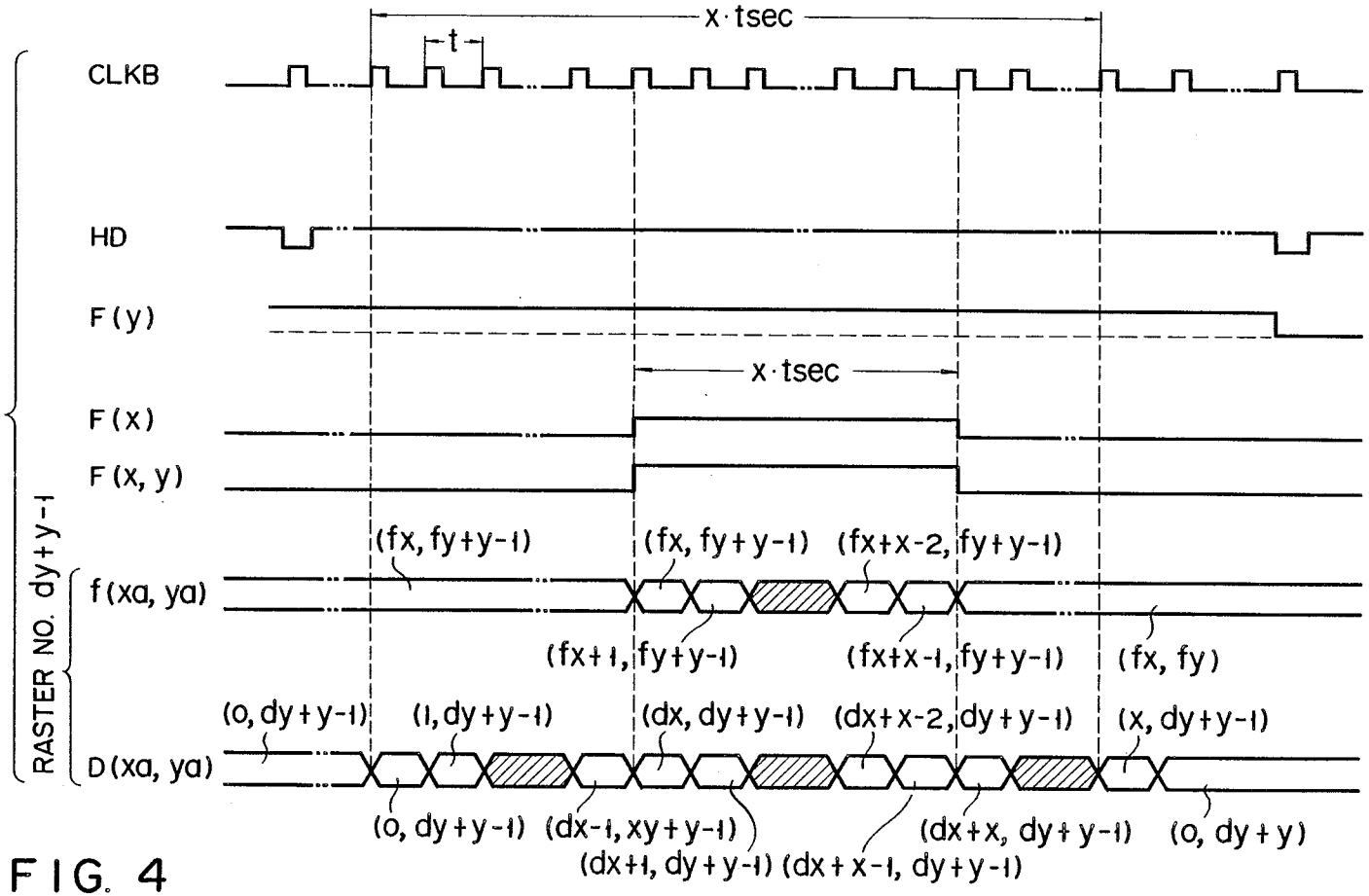
Figure 5:
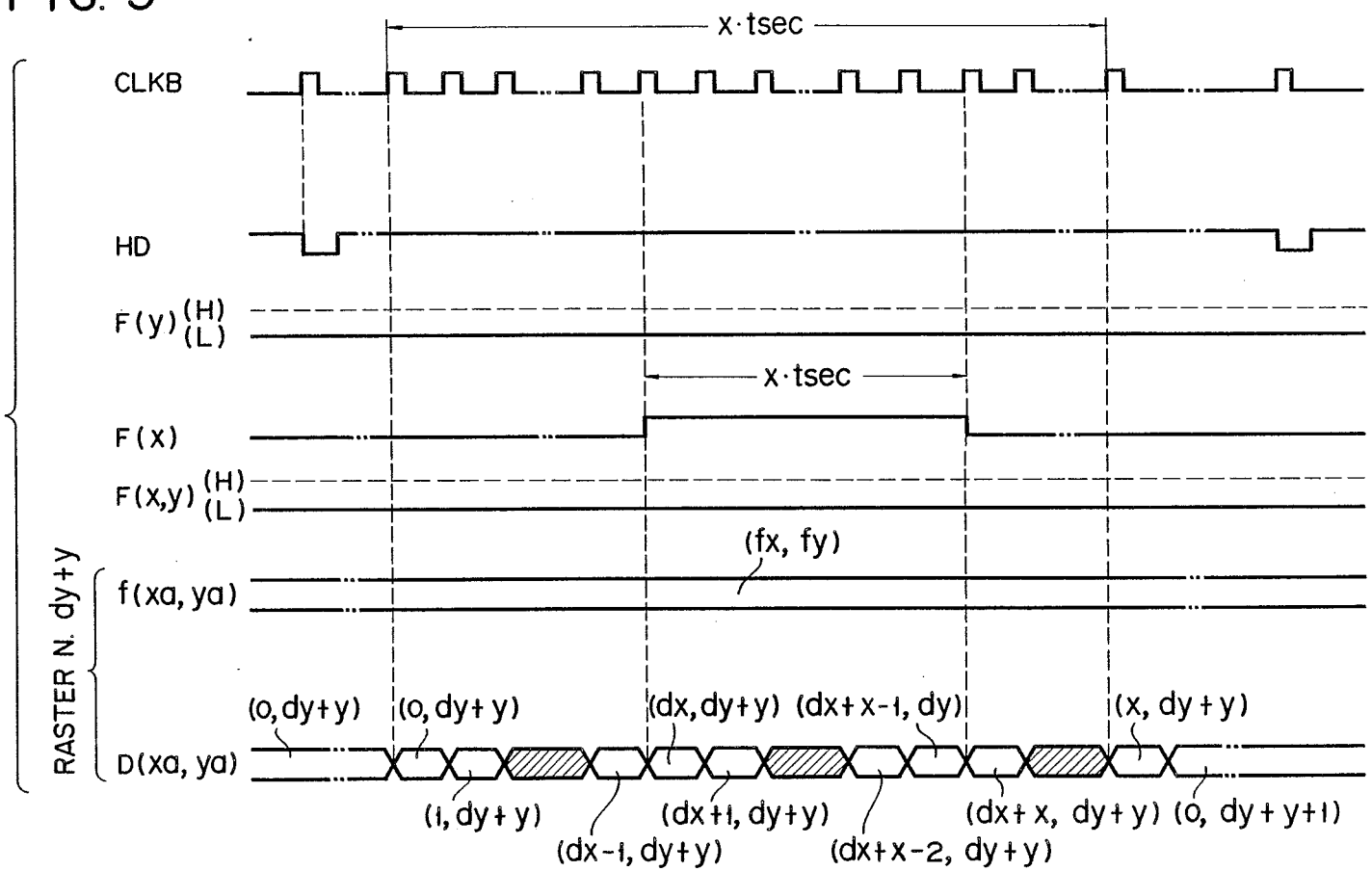

When the partial transfer matrix is given by x and y addresses, a horizontal transfer time address is given to be Xt sec, as shown in FIGS. 3 and 4. The partial transfer address f(xa,ya) of the frame memory 10 during the Xt sec period is incremented by the FM address counter 2 in an order of (fx,fy), (fx+1,fy), . . . (fx+x−2,fy), (fx+x−1,fy) up to (fx,fy+1). This partial transfer address f(xa,ya) is incremented by one address along the vertical direction (y direction) every time a line number, i.e., a raster number dy, is increased. In this case, the display memory address D(xa,ya) is updated in an order of (0,dy), (1,dy), . . . , (dx−1,dy), (dx,dy), (dx+1,dy), . . . , (dx+x−1,dy), (dx+x,dy), . . . during the horizontal display time Xt sec of the display unit. The display memory address data D(xa,ya) is used for displaying the matrix size x,y on the display unit. It should be noted that the timings of the respective signals, excluding the area of the vertical direction partial transfer address (corresponding to the time) y·H of FIG. 2, are illustrated in FIG. 5. In this case, since $F(y)=0$ is established, the product F(x,y) becomes logic "0".

When the product F(x,y) of the signals F(x) and F(y) falls within the area (i.e., partial transfer area) of $F(x,y)=H$, the AND output $\overline{DWE}$ from the AND gate 8 is enabled, so that the image data at the frame memory address (fx,fy) is written at the address (dx,dy) of the display memory 11 through the data conversion memory 7. In other words, the image data is transferred from the frame memory 10 to the display memory 11 while the signal $\overline{DWE}$ is being enabled.

In this manner, the partial transfer address S(x,y) from the frame memory 10 is updated for every frame (one picture) in synchronism with the vertical sync signal VD, so that the plurality of images stored in the frame memory 10 are sequentially displayed on the display unit (not shown) at the rate (VD period) of the display unit.

A scanned image in the X-ray CT equipment has a moving portion (e.g., heart) and a stationary portion (e.g., the background such as a bone). When the image data representing only the portion in motion is read out from the frame memory 10, the capacity of the operating portion of the frame memory 10 can be decreased, and cine display switching of the display image on the display unit can be easily performed at a higher speed.

In the above embodiment (corresponding to the timing charts in FIGS. 2 to 5), image data transfer from the frame memory 10 to the display memory 11 is completed during a one-frame period (between two adjacent vertical sync VD periods). However, even when every other scanning line is scanned in the interlaced scanning mode, partial transfer can be performed.

Figure 6:
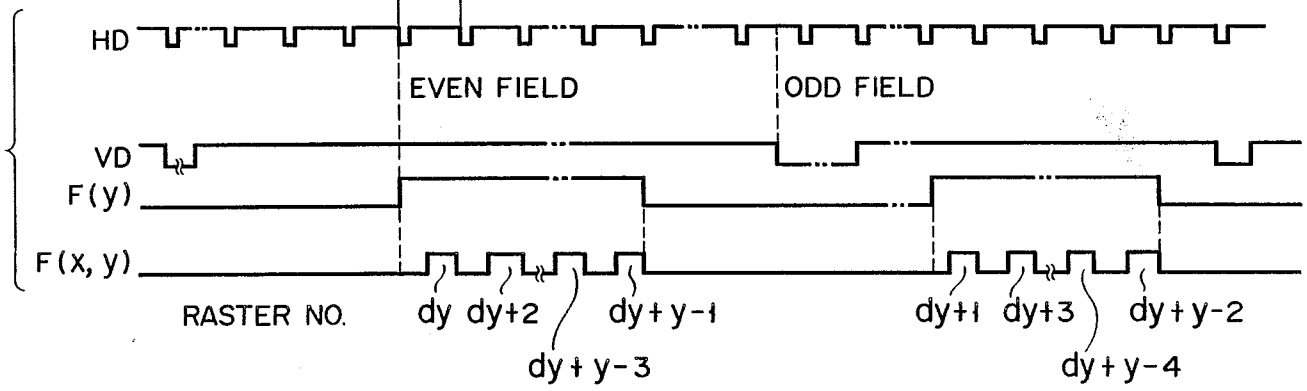
FIG. 6 is a timing chart of signals for explaining the operation of an image display apparatus according to a second embodiment of the present invention.

As shown in FIG. 6, according to a second embodiment, one-frame image data can be transferred by a set of even- and odd-field image data. Since interlaced scanning is performed, the vertical address increment operation of the FM and DM address counters 2 and 5 does not correspond to that of the first embodiment, although the horizontal address increment operation of the second embodiment is the same as that of the first embodiment.

Referring to the timing chart in FIG. 3, the odd-and even-field image data can be alternately transferred in units of pixels. In the even field period, only the even-field address data is transferred by the signal F(xa,ya). The odd-field address data is transferred by the signal F(xa,ya) during the even field period.

Figure 7:
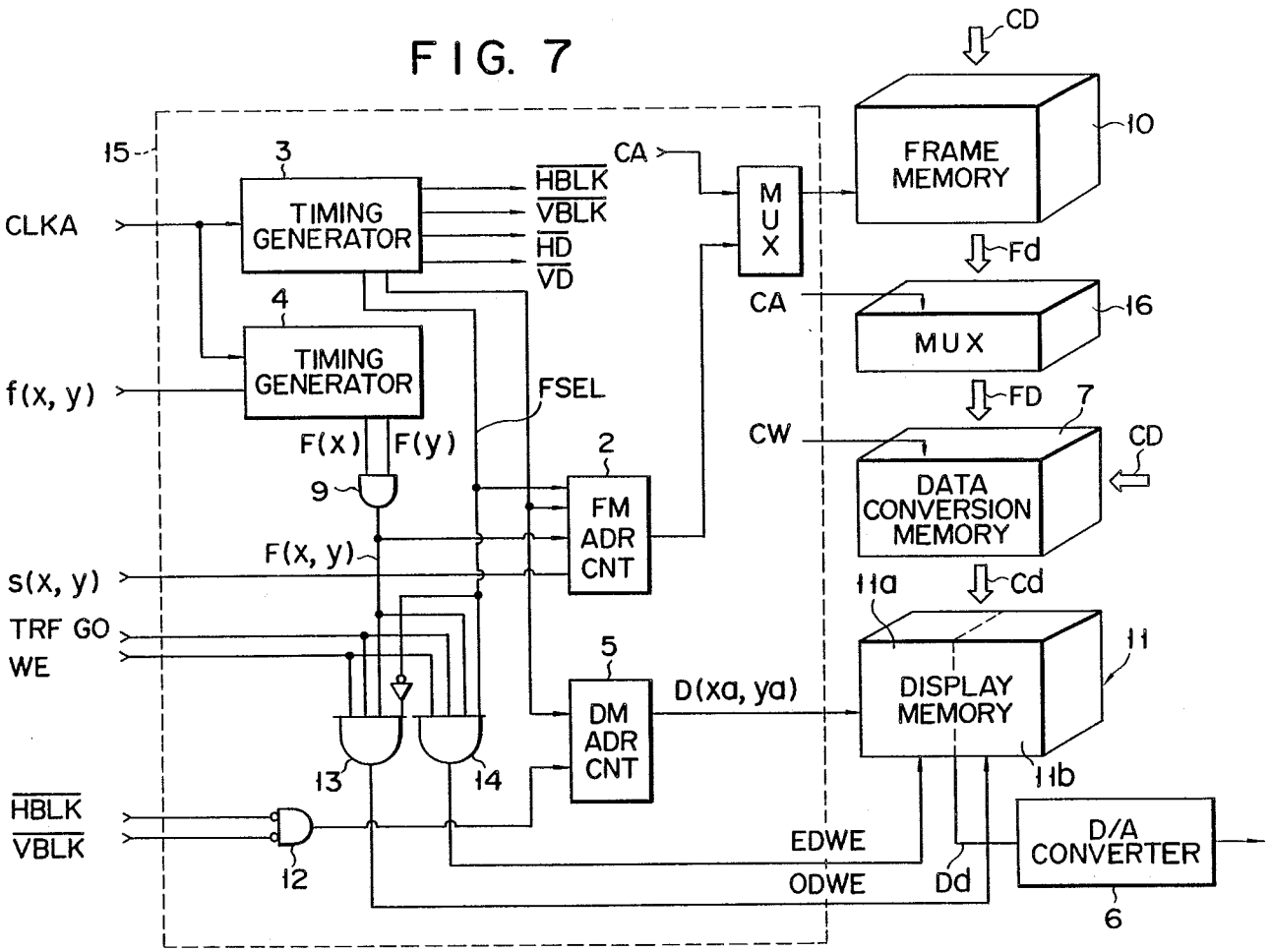
FIG. 7 is a block diagram showing a schematic configuration of an image display apparatus according to a third embodiment of the present invention.

The image display apparatus according to a third embodiment of the present invention adopting this transfer method is illustrated in FIG. 7.

Referring to FIG. 7, the logical products of an output FSEL from the timing generator 3 and the signals WE, TRFGO and F(x,y) are generated from AND gates 13 and 14. An even field memory (EMEM) 11*a* and an odd field memory (OMEM) 11*b* of a display memory 11 are switched such that the odd field is enabled in response to an output ODWE from the AND gate 13, and the even field is enabled in response to an output EDWE from the AND gate 14. In this case, an FM address counter 2 is also switched for the even and odd addresses in response to the signal FSEL. According to the arrangement described above, partial transfer of the image data in interlaced scanning can be performed. In this case, the even- and odd-field image data are alternately transferred to the display memories 11*a* and 11*b* in units of pixels. Therefore, the access rates of the display memories 11*a* and 11*b* can be decreased, so that low-speed memories can be used as the display memories 11*a* and 11*b*, respectively.

The partial image data transfer in the image display apparatus according to the present invention is performed such that, in addition to cine display, different types of images stored in the frame memory 10 can be simultaneously displayed by partially transferring the image data of any size x,y ($X \geqq x$ and $Y \geqq y$) from any start address S(x,y) of the frame memory 10 to the start position dx,dy of the display memory 11.

Two identical slow memories may be used to constitute the display memory. In this case, these two memories are used alternately such that data is written in one memory, while data is read out from the other memory.

What is claimed is:

1. An image processing system comprising:

a frame memory for storing original image data;

processing means for processing said original image data in a predetermined format for display as a visual image corresponding to said original image data;

a display memory for temporarily storing said processed image supplied from said processing means;

display means for displaying said visual image corresponding to said processed image data read out from said display memory in response to a synchronizing signal;

address signal generating means for generating a read address signal in synchronism with the synchronizing signal, and responsive to a signal representative of a position and size of a part of the displayed image on said display means; said read address signal being altered responsive to every occurrence of said synchronizing signal, for reading out at least part of the original image data stored in said frame memory, said at least part read out corresponding to said size of said part of the displayed image on said display means; and transferring means for synchronizing the reading out of said original image data from said frame memory in response to said read address signal and the writing of the image data generated from said processing means in which said read-out original data is processed and temporarily stored in said display memory so as to display the predetermined-formatted image in a corresponding location to said read address signal of said display memory.

2. A system according to claim 1, wherein said processing means stores a data conversion table which is programmable by an external circuit.

3. A system according to claim 1, wherein said processing means comprises a memory for storing a value of the predetermined image data at an address corresponding to a value of the original image data.

4. A system according to claim 1, characterized by further comprising means for externally setting an area of an image corresponding to the read address signal generated by said address signal generating means.

5. A system according to claim 1, wherein said display means displays an image in accordance with non-interlaced scanning.

6. A system according to claim 1, wherein said display means displays an image in accordance with interlaced scanning.

7. A system according to claim 6, wherein said display memory comprises an even-field memory element and an odd-field memory element.

8. A system according to claim 7, wherein said address signal generating means generates an even-field address during an even-field display period and an odd-field address during an odd-field display period.

* * * * *